US007694356B2

(12) United States Patent
Bouiss

(10) Patent No.: US 7,694,356 B2
(45) Date of Patent: Apr. 13, 2010

(54) STORAGE CHAMBER COVER

(76) Inventor: Mike Bouiss, P.O. Box 251, Ketchum, ID (US) 83340-0251

( * ) Notice: Subject to any disclaimer, the term of this patent is extended or adjusted under 35 U.S.C. 154(b) by 260 days.

(21) Appl. No.: 10/948,521

(22) Filed: Sep. 22, 2004

(65) Prior Publication Data

US 2006/0059614 A1 Mar. 23, 2006

(51) Int. Cl.
*E04H 4/00* (2006.01)

(52) U.S. Cl. ..... 4/498; 4/502

(58) Field of Classification Search ..... 4/488, 4/498–500, 502, 506; 220/825, 833, 244, 220/291, 810, 811, 816, 821, 827, 832, 252; 160/23.1

See application file for complete search history.

(56) References Cited

U.S. PATENT DOCUMENTS

| | | | |
|---|---|---|---|
| 3,019,450 | A | 9/1958 | Karasiewicz |
| 3,050,743 | A | 8/1962 | Lamb |
| 3,076,975 | A | 2/1963 | Lamb |
| 3,748,664 | A | 7/1973 | Morita |
| 3,979,782 | A | 9/1976 | Lamb |
| 4,195,370 | A | 4/1980 | Budd |
| 4,195,622 | A | 4/1980 | Dolza et al. |
| 4,203,174 | A | 5/1980 | Shults |
| 4,234,973 | A | 11/1980 | Vetter et al. |
| 4,262,373 | A | 4/1981 | Chambers |
| 4,324,370 | A | 4/1982 | Guard et al. |
| 4,351,072 | A | 9/1982 | Smith |
| 4,407,027 | A | 10/1983 | Colon, Jr. |
| 4,459,711 | A | 7/1984 | Sartain et al. |
| 4,467,978 | A | 8/1984 | Farrington |
| 4,471,500 | A | 9/1984 | Long et al. |
| 4,494,256 | A | 1/1985 | Radtke et al. |
| 4,686,717 | A | 8/1987 | MacDonald et al. |
| 4,764,998 | A | 8/1988 | Norris et al. |
| 4,815,152 | A | 3/1989 | MacDonald et al. |
| 4,939,798 | A | 7/1990 | Last |
| 5,044,022 | A | 9/1991 | Hess |
| 5,107,552 | A | 4/1992 | Lavalliere et al. |
| 5,327,590 | A | 7/1994 | Last |
| 5,555,574 | A | 9/1996 | Wason et al. |
| 5,606,749 | A | 3/1997 | Lavalliere et al. |
| 5,701,613 | A | 12/1997 | Richardson |
| 5,860,413 | A | 1/1999 | Bussey, Jr. et al. |
| 5,887,296 | A | 3/1999 | Handwerker |
| 5,913,613 | A | 6/1999 | Ragsdale et al. |
| 5,927,042 | A | 7/1999 | Last |
| 5,930,848 | A | 8/1999 | Last |
| 5,946,743 | A | 9/1999 | Hashmi |
| 6,014,778 | A | 1/2000 | Varnado |
| 6,026,522 | A | 2/2000 | Last |

(Continued)

*Primary Examiner*—Huyen Le
(74) *Attorney, Agent, or Firm*—Marger Johnson & McCollom, P.C.

(57) ABSTRACT

Disclosed and described is a rotating access cover assembly that may be utilized to cover a storage chamber such as those that store swimming pool covers. In a swimming pool setting, the access cover assembly allows complete access to the storage chamber by the swimming pool cover, which extends the width of the swimming pool. Allowing such access to the chamber, the access cover assembly provides support so that users may walk and sit on the edge of the pool and the edge of the access cover assembly. The access cover rotates to an open position to allow access to all or part of the storage chamber of the swimming pool cover.

53 Claims, 13 Drawing Sheets

U.S. PATENT DOCUMENTS 6,324,706 B1 12/2001 Epple
6,421,845 B1 7/2002 Bertoni
6,446,276 B2 9/2002 Mathis
6,513,175 B2 2/2003 Bertoni
6,760,930 B2 * 7/2004 Bertoni ..... 4/502
6,862,756 B2 * 3/2005 Mathis ..... 4/502
6,886,188 B2 * 5/2005 Epple et al. ..... 4/502
7,318,243 B2 * 1/2008 Smith ..... 4/661
2003/0084502 A1 * 5/2003 Epple et al. ..... 4/502
2004/0149397 A1 * 8/2004 Last ..... 160/133

* cited by examiner

STORAGE CHAMBER COVER

BACKGROUND OF THE INVENTION

1. Field of the Invention

The present invention generally relates to access covers for storage chambers, and more particularly to access covers for storage containers for housing swimming pool covers.

2. Background Information

It is highly advantageous to use a pool cover with a swimming pool. The pool cover reduces evaporation of the water and use of chlorine keeps dust and other debris out of the pool, reduces heat loss, and generally improves the functions of a swimming pool.

Swimming pool covers are most effectively utilized on a swimming pool that is generally rectangular in shape. In many cases, the pool cover extends the width of the pool and is stored in a rolled up condition that is as wide as the pool. From the rolled up condition, the swimming pool cover is extended out over the top of the water the length of the pool. When the pool is to be utilized, the swimming pool cover is retracted from the surface of the water and typically wound on an axle into a storage chamber adjacent one end of the pool.

With such an arrangement, there is typically a cover over the storage chamber in which the pool cover is stored. The cover of the storage chamber forms the fourth pool side edge, and thus comprises a significant amount of the pool side area. Because the swimming pool cover must extend the entire width of the pool without interruption, to allow the passage of the pool cover, the lip of the storage chamber cover must be unsupported for the entire width of the pool. This presents problems in that it is also desirable to have the entire distance along this edge of the pool usable by persons using the pool. One solution to this problem is to use L-shaped brackets to support the storage chamber cover, similar to how a bookshelf is supported on a wall. This arrangement presents problems in that a weight limitation is imposed on users of the edge of the swimming pool, and exceeding the strength of the supporting brackets is always a concern. Additionally, it is important that the storage chamber cover be removable or operable to allow access to the mechanics of the storage mechanism for the swimming pool cover. This can include motors, gears, axles and bearings. It is desirable to have the entire width of the swimming pool cover accessible without such access presenting a huge project.

Thus, it would be desirable for the cover of a storage chamber exemplified by a swimming pool cover storage chamber to be easily accessible and yet be easily closed in a way that the unsupported edge of the cover would safely bear the weight of users without the users having to be concerned with structural failure.

It is also desired that a cover for such a storage chamber be easily moved from an open to a closed position. It is also desired that when in the open position, the storage cover would be stored in such a way that it cannot accidentally rotate into the closed position with the possibility of injuring a person.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The access cover assembly of the invention accomplishes these and other objects. The access cover assembly of the invention is made to cover a storage chamber that is typically set with an opening at ground level. The storage chamber has a left and a right end wall, a front sidewall, a back sidewall and a chamber floor. Such storage chambers are typically mounted adjacent to an in ground swimming pool and extends the entire width of the swimming pool providing roll-up storage for a swimming pool cover. The access cover assembly of the invention can also be used for other storage chambers that have similar needs for easy opening for the storage chamber while providing the strength over a long span for weight bearing across the span. In the case of the swimming pool storage chamber, the access cover must extend the entire width of the pool and be unsupported in the middle, yet provide sufficient strength across that span for users of the pool to be able to walk along the top of the access cover and sit on its edge adjacent the swimming pool. Other storage chambers might have use of a similar access cover assembly and are to be found as pump housings, drainage galleries, shelter units and sub-grade vaults, for example.

The access storage cover assembly of the invention includes a pivot structure by which the cover deck of the access cover assembly may be rotated in order to expose the inside of the storage chamber. The pivot structure includes a left pivot support and a right pivot support. The access cover assembly also includes a cover deck that is attached to the pivot structure. The upper side of the cover deck has a first side adjacent to the front sidewall of the storage chamber and a second side opposite the first side. The cover deck is configured to rotate between an open position and the closed or service position. The service position is typically a horizontal position, which allows users to walk on the cover deck when the storage chamber is covered. When the cover deck is rotated around the pivot structure, the storage chamber is open and available for access. The device also includes a locking assembly for locking the cover deck in either the open or service position.

The pivot structure can be a fixed shaft or section of a shaft that is attached to the cover assembly. This version of the access cover assembly fits into a bearing, which may be attached to the sidewalls or chamber floor of the storage chamber. In this version of the device, the access cover is attached to the shaft and the access cover rotates by the shaft rotating in a bearing.

These positions could also be reversed and the bearing could be attached to the cover assembly, with the fixed shaft being attached to the end walls of the storage chamber or the chamber floor.

Another construction of the access cover assembly of the invention is one in which the pivot structure is an axle that is supported by two axle supports. These are equivalent of the left pivot support and the right pivot support, and are termed the left axle support and the right axle support. The cover deck is attached to the axle and the axle, with its attached cover deck, is able to rotate in the left and right axle supports and thus moves the cover deck between the open position and the service position.

The axle and the cover deck can be configured in several different configurations. In one configuration, the axle is positioned on the underside of the cover deck and is generally equidistant between the first side and the second side of the cover deck. It could also be configured so that the axle is adjacent to the first side of the cover deck and thus is adjacent to the side of the storage chamber or the swimming pool cover storage chamber. It could also be configured so that the axle is adjacent to the second side of the cover deck.

The access cover assembly of the invention can extend the entire length of the storage chamber and cover the entire chamber where the swimming pool cover is stored. It can also be made in sections so that only the section above the swimming pool cover motor and mechanicals can be raised for access to the mechanical portion of the swimming pool cover roller. The other sections could optionally be accessible by the access cover of the invention and could be broken into several parts. For example, three or four different access cover covers could cover the storage chamber for a swimming pool cover. Only the one (or the ones) that were needed would be opened for accessing the swimming pool cover and its mechanical components. The axle of the invention can be supported in various formats, all of which fall within the concept of the invention. For instance, the left and right axle supports could be mounted on the left and right end walls, with the axle extending the complete distance between the end walls. Alternatively, the axle supports could be mounted on the chamber floor and extend upward to provide support for the axle. Also, one or more medial axle supports are alternative designs and would support an axle that extended over a longer distance. The medial axle support would typically be mounted on the chamber floor and include an upright that extends an axle support to the level of the axle.

The access cover can also include spar ribs that are attached to the cover deck and which provide support to the cover deck. The spar ribs, if present, are attached to the cover deck and the axle. If upright axle supports are utilized, one or more gussets can be utilized for lateral stability. The medial axle supports can also include one or more gussets.

The access cover assembly also includes a block that locks the cover deck in either the open or the service position. This can be accomplished by using two blocks, one for locking in the open position and one for locking in the service position.

Since the cover deck rotates around the axle, there is provided an anti-rotation block so that the cover deck does not rotate too far. Rotation can be away from the first side of the cover deck, also known as the pool side. The rotation of the cover deck can also be towards the pool side. An anti-rotation block is typically provided, which keeps the cover deck from rotating too far in the direction of the pool side. This anti-rotation block can be an inner fitting joint on the back sidewall, which interacts with the back edge or deck side of the cover deck. This could be configured something like a lap joint, which prevents over rotation towards the pool. Further anti-rotation safety is provided by the fit of the cover deck into the sides of the pool on the left and right side of the pool. This can be by use of an inner fitting joint in which a tongue on the cover deck fits with a groove on the pool side to prevent further rotation of the cover deck towards the pool side.

The access cover assembly would also typically include a deck side anti-rotation block. This could take several forms, with one being one or more coil springs that control and stop the rotation of the cover deck towards the deck side. The coil spring would thus act as a block and as a cover deck brake means. An arc could also stop excess rotation of the cover deck towards the deck side, which is not concentric with the arc of the cover deck so that continued rotation causes contact of the cover deck with the arc and stops at some point. The arc could have a radius the same as or close to the radius of the cylinder of rotation of the cover deck, but could have its center slightly above the center of the cylinder of rotation of the cover deck. This would cause the edge of the cover deck to gradually brake itself against the arc of the braking arc, and serve as a different type of cover deck brake means.

The cover deck and axle can also be configured so that in the open position, the center of gravity of the cover deck is on the deck side of the axle. This way the cover deck would be stable and would not accidentally close on the storage chamber and any worker who happened to be in the storage chamber. In order to close the cover deck in this configuration of the device, the cover deck would have to be rotated towards the pool side.

The access pool cover also includes a lock assembly that locks the cover deck in the open position.

The access cover assembly can have several different systems for causing rotation of the cover deck. These can be from a simple lever that is inserted into a receiving tube in the cover deck, to more complicated systems. A system utilizing sprocket and chain or gear drives are two other types of mechanical systems for raising and lowering the cover deck. Hydraulic systems can also be utilized and the geared system can be powered by an electric motor. Another possible system for causing rotation of the cover block involves having a water chamber mounted on the underside of the cover deck and pumping water from the swimming pool into the water chamber to change the center of gravity of the cover deck until it rotates to the open position by the weight of the water. Pumping water out of the water chamber would again change the center of gravity of the cover deck and allow it to rotate back into the service position.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
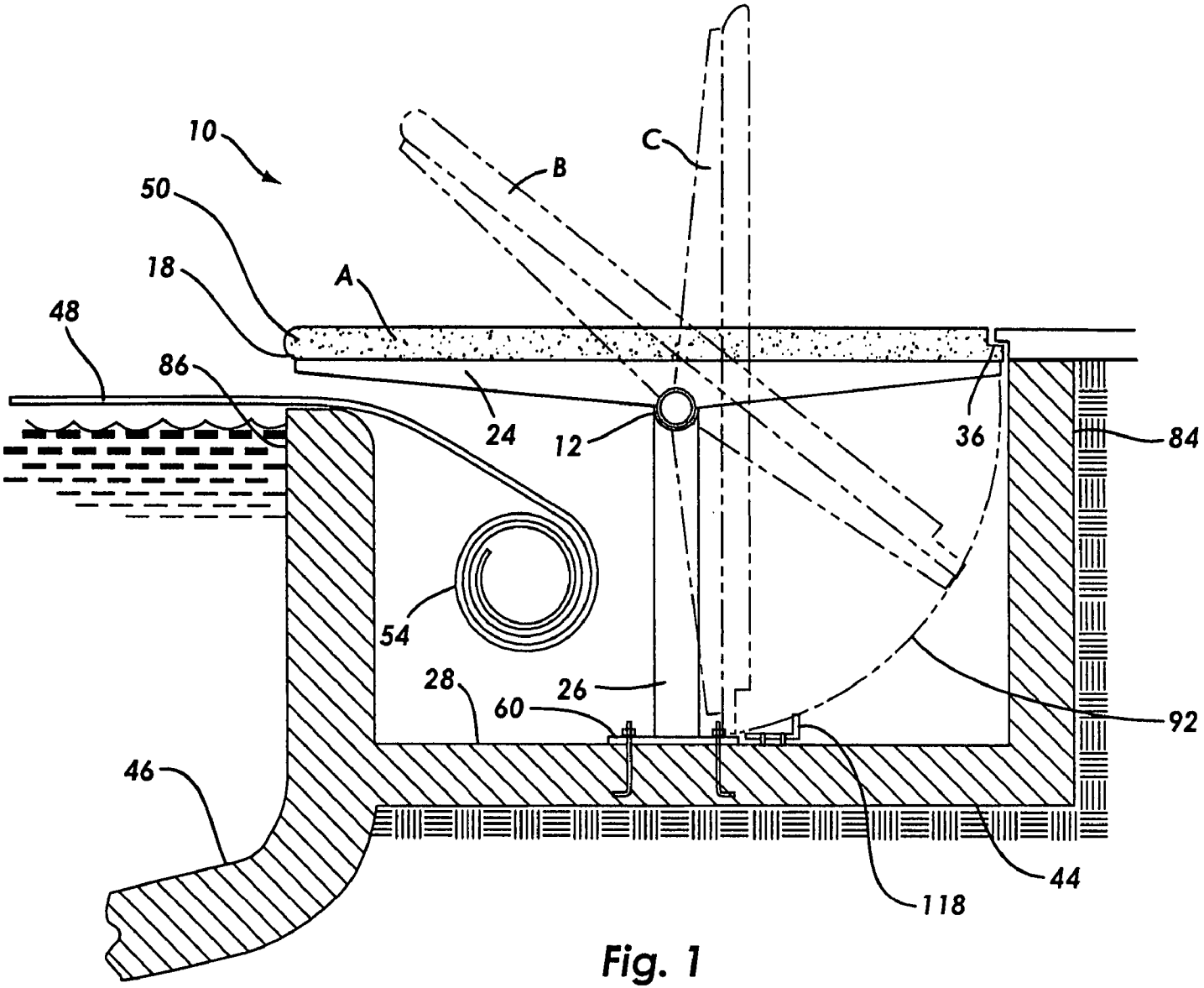
FIG. 1 is a side view of the storage chamber cover showing a closed and open position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
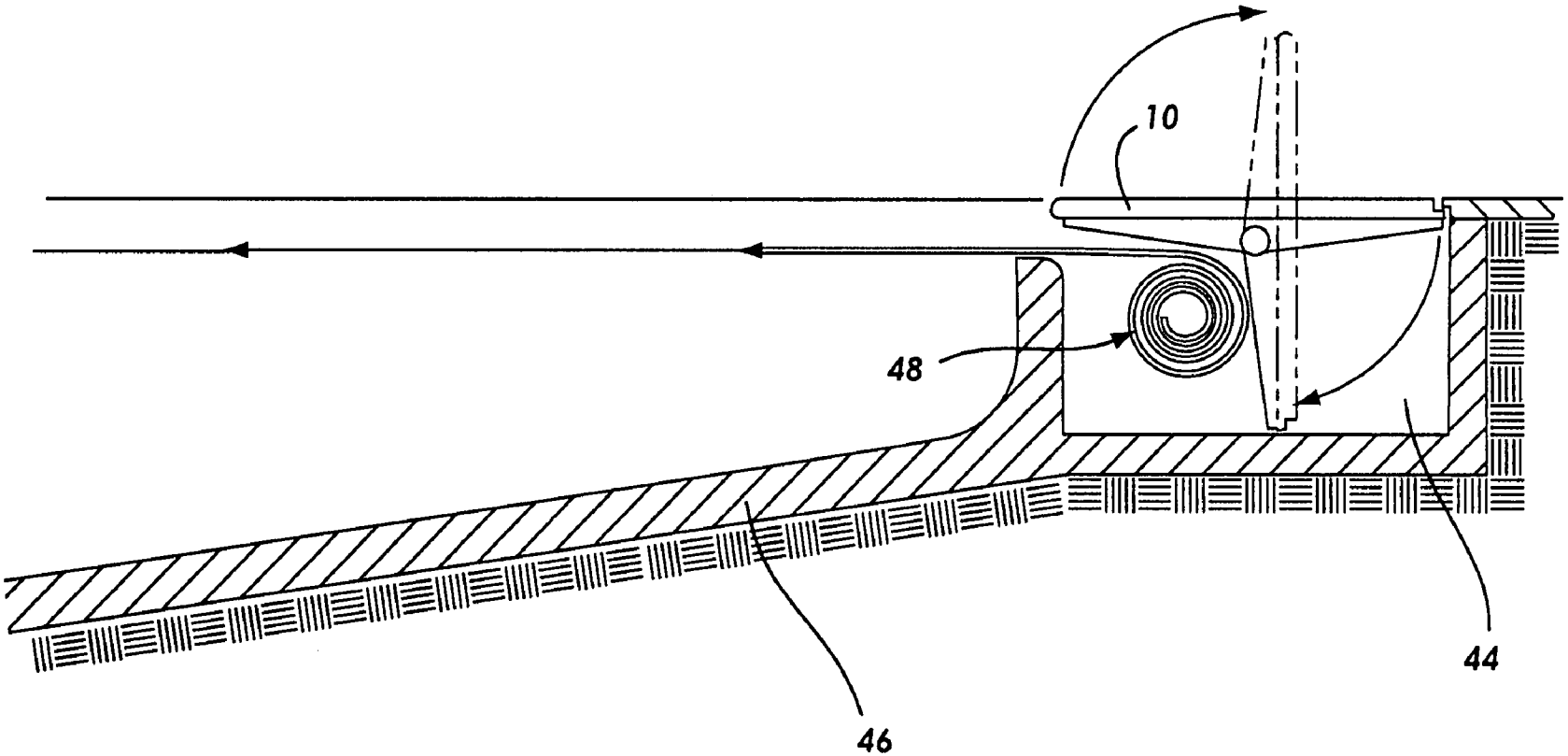
FIG. 2 is a side view of the swimming pool, storage chamber and storage chamber cover of the present invention.

A preferred embodiment of the invention is shown in FIGS. 1-10. FIG. 2 shows the general positioning of the access cover assembly 10 of the invention, in relation to a storage chamber 44 adjacent to a swimming pool 46 in which a swimming pool cover 48 is stored. This is one example of the storage chamber 44, but other types of storage chambers would be equally benefited by use of the access cover assembly 10 of the invention. Other storage chambers might have use of a similar access cover assembly and are to be found as pump housings, drainage galleries, shelter units and sub-grade vaults, for example.

Figure 3A:
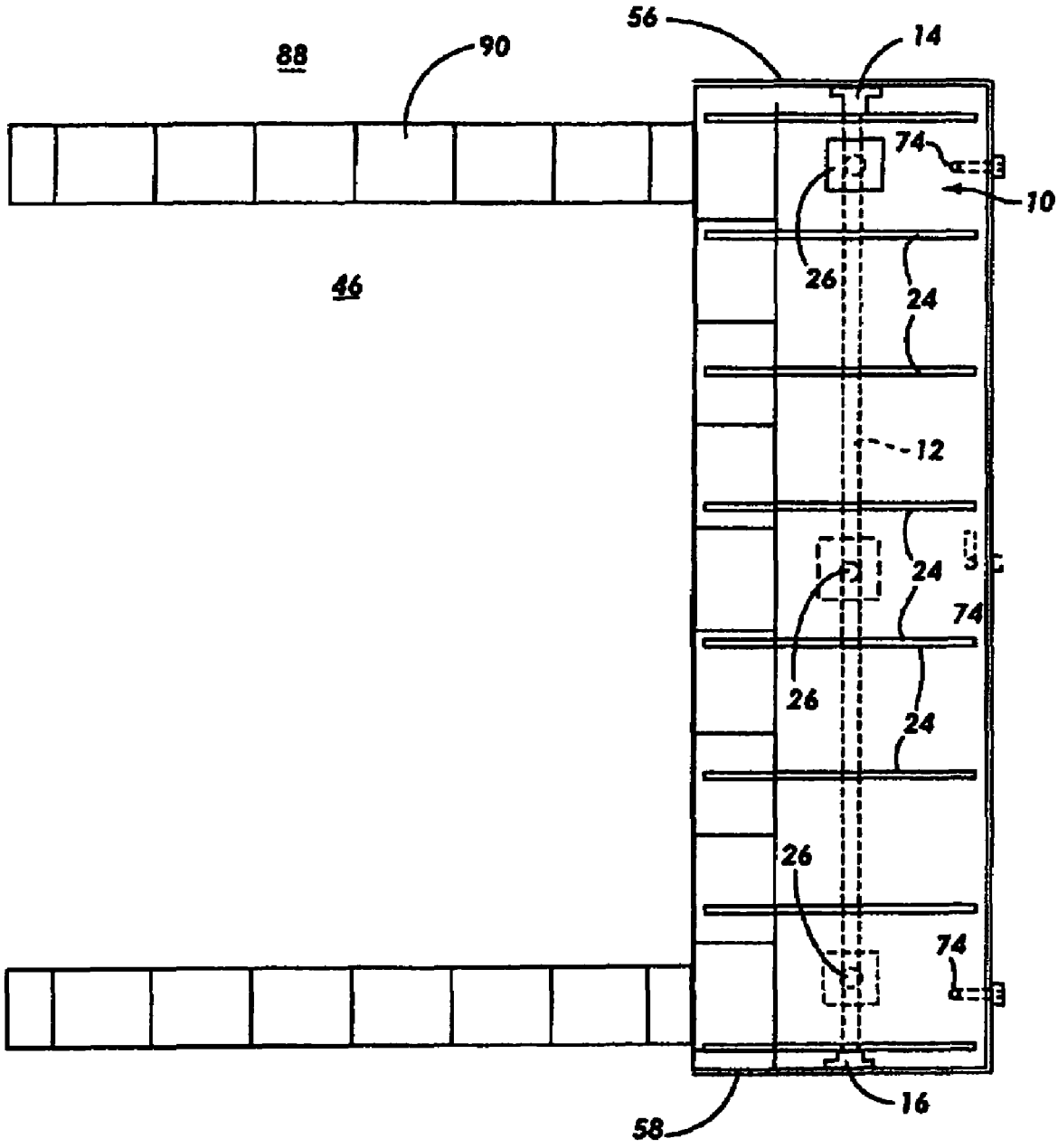
FIG. 3A is a top view of an end of a swimming pool and the storage chamber cover of the present invention.

FIG. 1 shows a cross-sectional side view of a preferred embodiment of the access cover assembly 10. It includes an axle 12, to which are attached a number of spar ribs 24. The spar ribs 24 support a cover deck 18. The cover deck 18 may be a surface that is exposed for use above the storage chamber 44. It may also be covered with a surface layer 50, which can be made of a material that matches the surrounding deck. This could be wood, tile, concrete, stone, aggregate or other material. The preferred embodiment includes at least two, and typically more than two, axle supports. Shown in FIG. 1 is an axle support 26 that is mounted to the chamber floor 28. This axle support 26 includes a base 60, which is shown as being bolted in place to the chamber floor 28. Other means of attachment are obviously also possible. Besides an axle support that is supported on the chamber floor, the device can include a left axle support 14 and a right axle support 16, as shown in FIG. 3A, that are mounted on the left and right end walls of the storage chamber 28. This type of wall mounted axle support could be bolted in place, poured in place with concrete, or attached by other conventional means. The axle supports provide a stationary bearing surface for the axle 12 to turn in.

Besides this configuration in which the axle is rigidly attached to the rotating cover deck, with stationary bearings that allow it to rotate, the device could work equally well if the axles were mounted in a stationary fashion to axle supports 14, 16 and 26, and the bearings were attached to the spars and cover deck so that the bearing could turn around the stationary axle. Similarly, the axle can be one rod that extends from one end of the device to the other, or it can also function in a number of sections, such as sections four to six feet wide that interface with a corresponding supporting bearing.

The problem that is faced by designers of storage chambers, especially those for swimming pool covers, is that the entire side adjacent to the swimming pool must basically be unsupported so that the swimming pool cover can be pulled on or off the surface of the water and onto a storage roll. This can result in quite a long span that must be unsupported for the width of the pool. However, best use of the swimming pool is had if all four edges of a generally rectangular swimming pool may be utilized for walking, sitting, standing and running. With a long span of deck edge over one side, the current practice does not result in an edge along the swimming pool that can be fully weighted and utilized like the other three edges. The access cover assembly of the invention addresses and solves that problem with a cover that also allows easy access to the swimming pool cover and its mechanical systems.

The cover deck 18 of the invention rotates from the service position, shown as A in FIG. 1, to a partially open position B, and to a fully open position C. In the fully open position C, a person can access the swimming pool cover storage spool 54 and mechanical systems that support that storage spool. This can include motors, gears, bearings and other devices that require maintenance, inspection and replacement. Thus the access cover assembly of the invention allows the swimming pool cover to be retracted over an entire side of a rectangular swimming pool and provides a pool edge that can be loaded for use by users of the pool and allows access to the swimming pool cover 48 and related equipment in the storage chamber 44.

FIG. 3A shows a top view of the access cover assembly 10 of the invention mounted on one side of a rectangular swimming pool 46, next to the deck 88 and the pool edge 90. Shown is the unitary axle 12, which extends from a left sidewall 56 to a right sidewall 58. In this version of the invention, a left axle support 14 is mounted on the left sidewall 56 and a right axle support 16 is mounted on the right sidewall 58. Also shown are medial axle supports 26. These would be spaced according to the engineering needs of a particular installation. For instance, the span to be supported and the material that is used to mount on the cover deck could drastically affect the weight of the rotating cover deck and might require more medial support of an axle. It might also require a larger axle. Similarly, the number of spar ribs 24 would be affected by the length, width, weight and composition of the deck required to support, and the width and length of the access cover assembly.

For these reasons, the access cover assembly 10 of the invention could be configured in many different sizes and the components of the access cover assembly 10 could be quite variable in size and distribution. By way of example, and without the intent of limiting the definition of the invention beyond what is defined in the appended claims, a suitable installation might be as follows. For a pool that has a side that is sixteen feet long, the cover deck 18 itself could be twenty feet long, which means that it extends a distance beyond the pool edge 90 of the swimming pool. It would typically be 48 inches wide. For an installation that uses wood as the surface layer 50, the cover deck 18 might be made of ¼ inch thick steel. For such an installation, approximately nine spar ribs 24 would be utilized, with each spar rib 24 being made of ¼ inch steel. The spar ribs shown in the figures are cut from ¼ inch steel plating, but other suitable spar ribs could be made from square or rectangular tubing, round tubing, angle iron, T-shaped material, I-beam shaped material, aluminum, titanium or conceivably even wood.

Figure 3B:
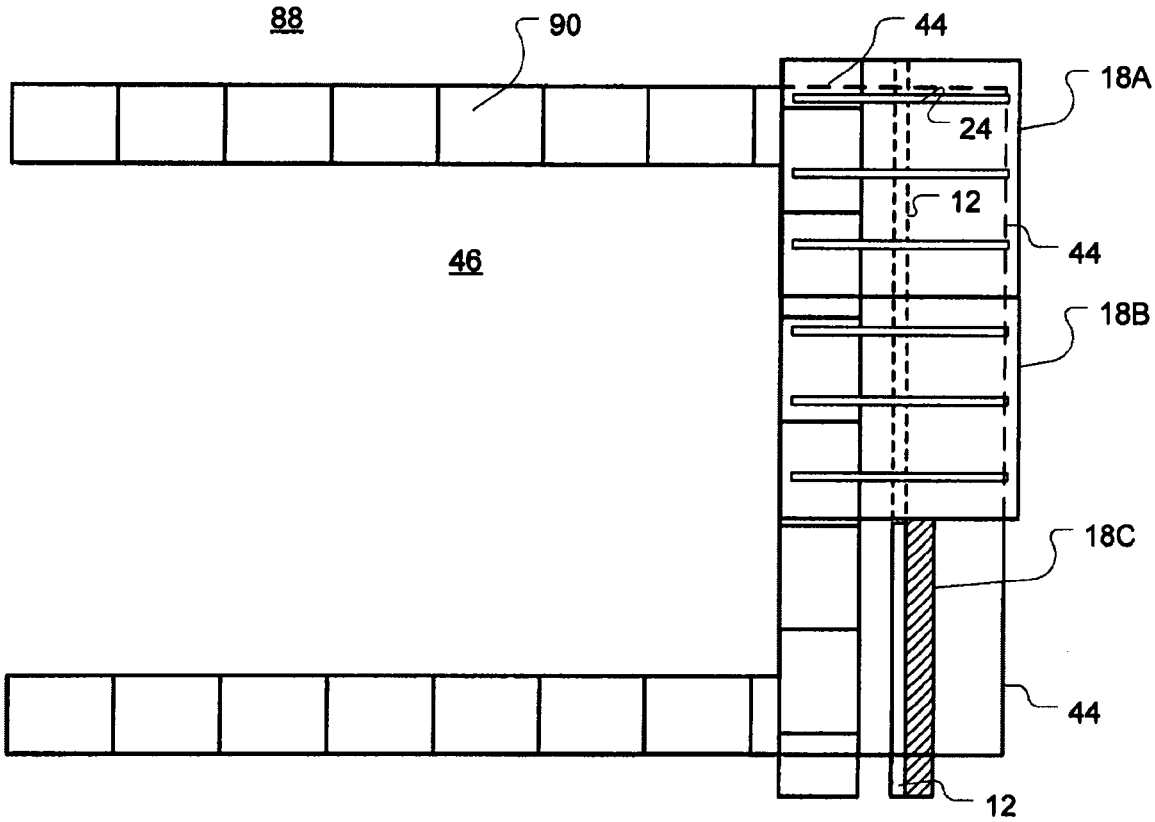
FIG. 3B is a top view of the storage chamber cover of FIG. 3A illustrating that sections of the storage chamber cover operate independent from one another.

FIG. 3B illustrates an embodiment of the invention where the cover deck 18 is formed of several sections, illustrated here as sections 18A, 18B, and 18C. In this embodiment, each of the sections 18A, 18B, and 18C operate independently; in other words, each section of the cover deck may be independently opened or closed. In this example, cover sections 18A and 18B are in the closed position while cover section 18C is in the open position. As described above, such an implementation allows a user access to the storage chamber 44 without requiring that the user open the entire cover deck 18.

Figure 4A:
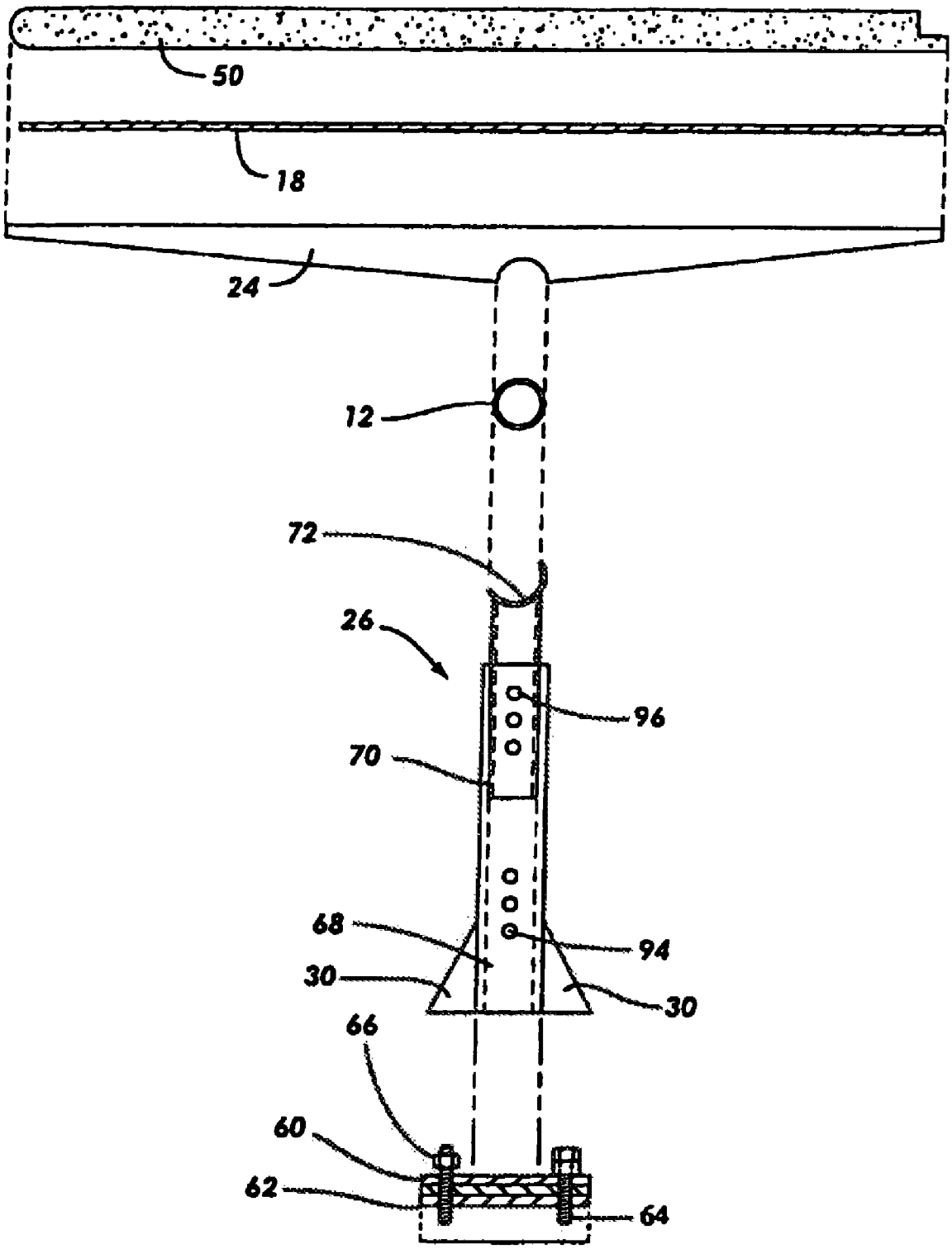
FIG. 4A is a side, exploded view of an axle support and cover deck of an embodiment of the present invention.
Figure 4B:
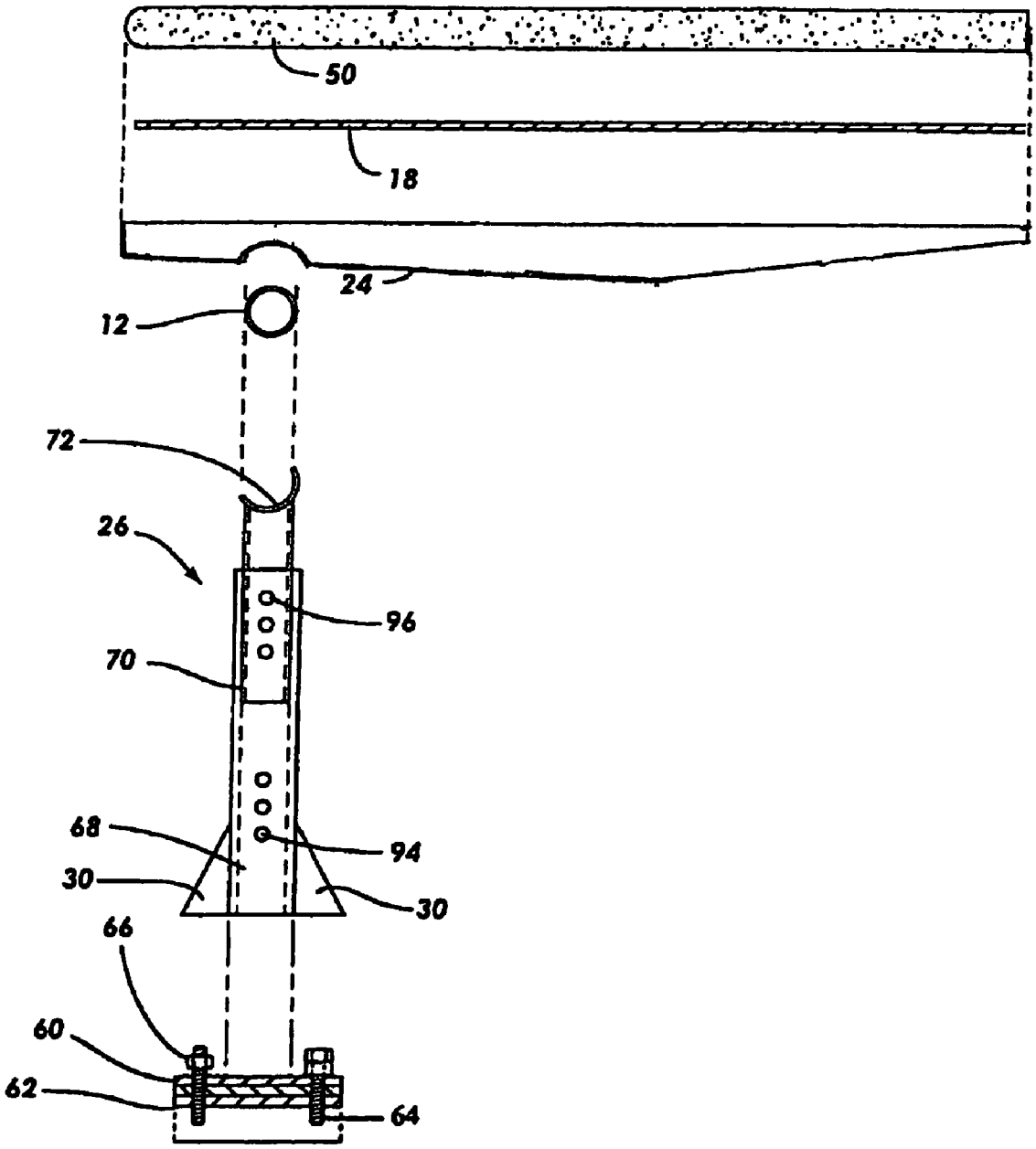
FIG. 4B is a side, exploded view of an axle support and cover deck of another embodiment of the present invention.
Figure 4C:
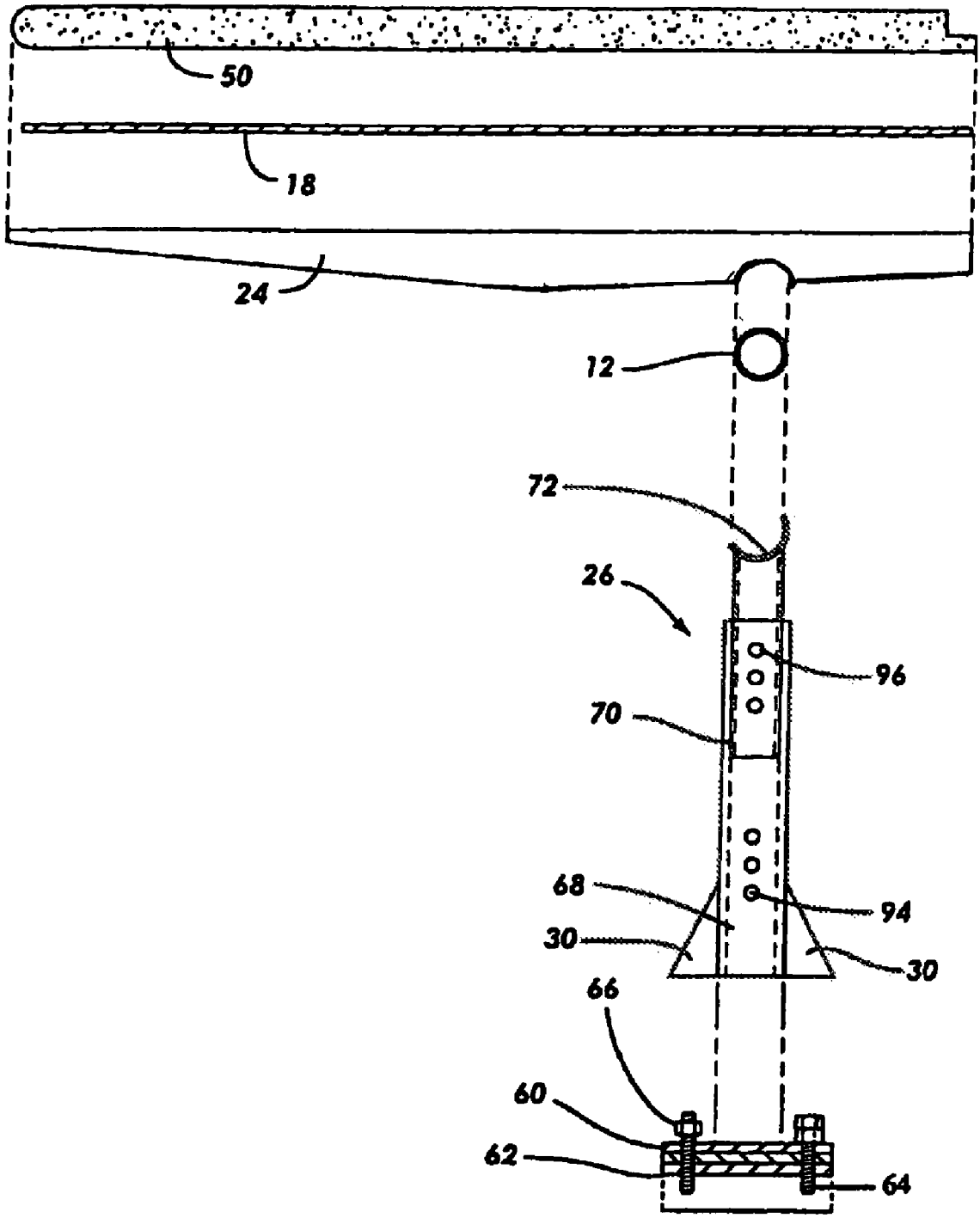
FIG. 4C is a side, exploded view of an axle support and cover deck of yet another embodiment of the present invention.

FIGS. 4A, 4B, and 4C show additional details of preferred embodiments of the freestanding or medial axle support 26, with the axle 12, spar rib 24 and cover deck 18. The medial axle support 26 includes a base plate 60, shims 62 as required, and a set of base bolts 64 and nuts 66. This design of the medial axle support 26 includes an outer column 68, which has a number of adjustment holes 94. The outer column 68 would typically be welded to the base plate 60. An inner sliding column 70 is inserted inside the outer column 68, and adjusted to the desired height by the use of adjustment holes 96. At the desired height, one or more bolts are inserted through the adjustment holes 94 and 96 of the outer column and the inner sliding column to lock the inner sliding column in place. This embodiment of the invention includes an axle cradle 72, which acts as a bearing surface for the axle 12. Within the axle cradle 72, the axle 12, the attached spar ribs 24 and cover deck 18 can rotate. While FIG. 4A illustrates the axle 12 in a central position of the cover deck 18, FIGS. 4B and 4C illustrate that it may also be located near one of the edges of the cover deck.

In the configuration described above and the embodiments shown in FIGS. 1 and 4A, 4B, and 4C, the base plate 60 would typically be twelve inches square, made of ½ inch steel, and the outer column 68 would be 3.5 inch round tubing made of ¼ inch thick steel. The inner column 70 would be made of three inch round tubing made of ¼ inch thick steel. The axle would be 3.5 inches in diameter and the axle cradle 72 would correspond to that diameter. The deck would support as much as 100 pounds per square foot. Gussets 30 can be added for stability. A vertical block 118 is shown for locking the deck in an upright position so that it cannot rotate in a counter clockwise direction in the view shown in FIG. 1.

A means must be provided to prevent over rotation of the access cover assembly towards the swimming pool. Such over rotation would cause damage to the swimming pool cover 48, which passes over the end wall of the swimming pool 46. One means of preventing this type of over rotation is in the lap joint 36 in which a lap joint, also called an interfitting joint, is formed between the cover deck 18 and the back sidewall 84 of the storage chamber 44.

Another structure that prevents over rotation towards the swimming pool sidewall 86 is seen in FIG. 3A. In FIG. 3A, the left sidewall 56 and the right sidewall 58 of the storage chamber 44 are wider than the width of the swimming pool. Thus, when the cover deck 18 is lowered to the surface position, it can fit in corresponding pockets in the surrounding deck 88 and the pool edge 90, thus preventing over rotation of the entire cover deck. The two mechanisms described above are examples of a pool side anti-rotation block.

It is also desirable to have an anti-rotation block that keeps the cover deck 18 from rotating in a clockwise direction in the view shown in FIG. 1. This would be the deck side anti-rotation block. A number of mechanical means to achieve this are possible, including a braking surface 92, as shown in FIG. 1, which has the approximate arc described by the rotating cover deck 18. However, the center of this arc is slightly offset from the axle of the cover deck. As the cover deck approaches a vertical position C, increased friction between the cover deck 18 and the braking surface 92 cause a slowing and stopping of the rotation of the cover deck 18. The braking surface can be a ledge built into the left or right side wall 56 or 58, or can be a structure attached to a medial axle support 26 or the storage chamber 44.

An important feature of the preferred embodiment is that the center of gravity of the cover deck, when it is in the C position, is to the deck side of the axle. Thus, it does not have a tendency to rotate in a counter clockwise direction in the view shown in FIG. 1, which could possibly injure a person accessing the storage spool 54 or the mechanical features associated therewith. In the A position, the center of gravity of the deck is approximately neutral.

Figure 5A:
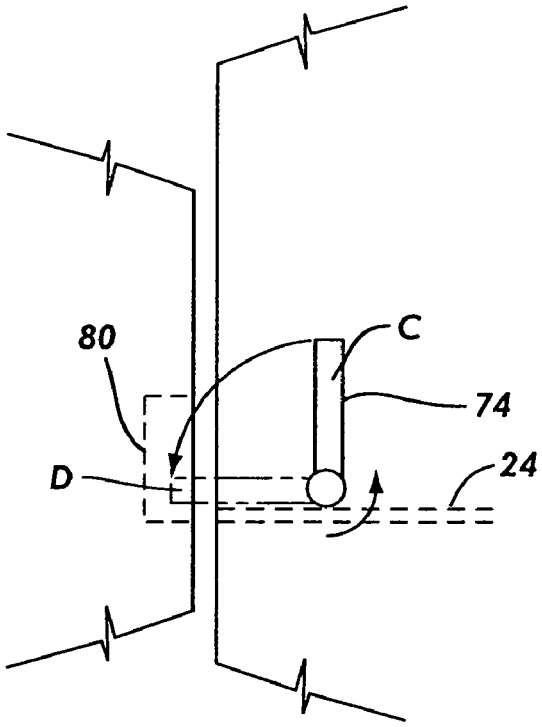
FIG. 5A is a top view of the locking mechanism for locking the cover deck to the swimming pool edge.
Figure 5B:
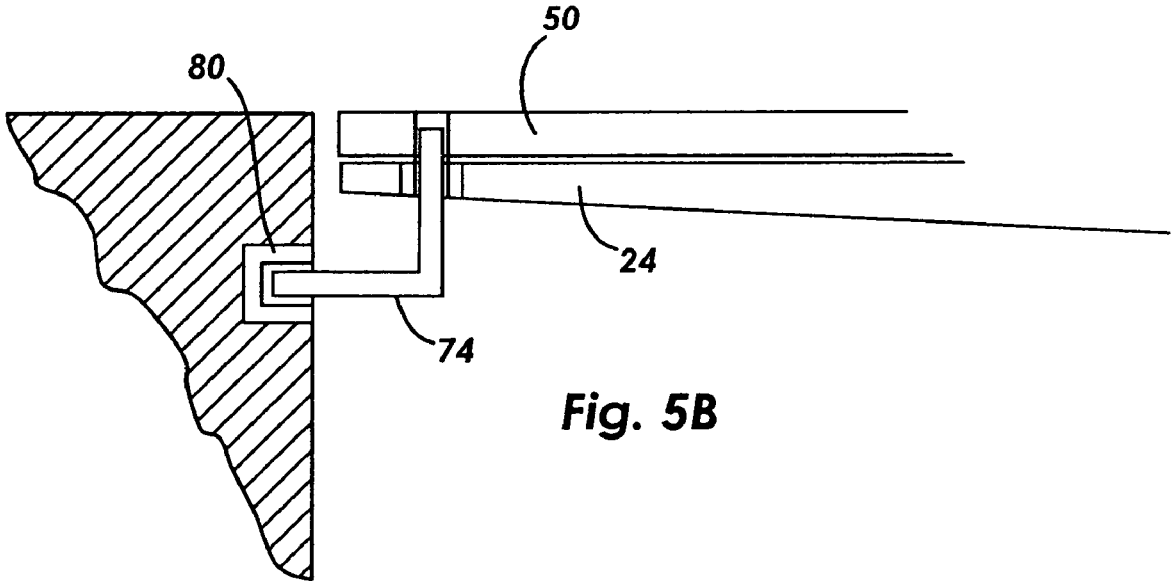
FIG. 5B is a side, cross-sectional view of a cover deck locking device locking the pool cover in the closed position.

In addition to anti-rotation blocks fore and aft, it is also desirable to have additional blocks mounted in the side of the cover deck where it intersects with the deck 88 to solidly block the cover deck 18 into the service position A. FIGS. 5A and 5B show two views of a blocking mechanism for blocking the cover deck in place and preventing rotation towards the pool or towards the deck. FIG. 5A is a top view showing a deck block 74, which swings from an open position C to a closed position D. In the closed position D, the deck block is engaged with a reinforced block passage 80 in the deck. In this position, the deck cover cannot open or rotate. When the block is moved to the open position C, the deck is free to rotate. FIG. 5B shows a side view of the same deck block 74, which is attached by a collar to the spar rib 24. A number of mechanisms can be used to turn the block 74, such as a screwdriver in a slot head on the block 74, a T handle tool or any tool that interacts with the block to turn it.

Figure 6:
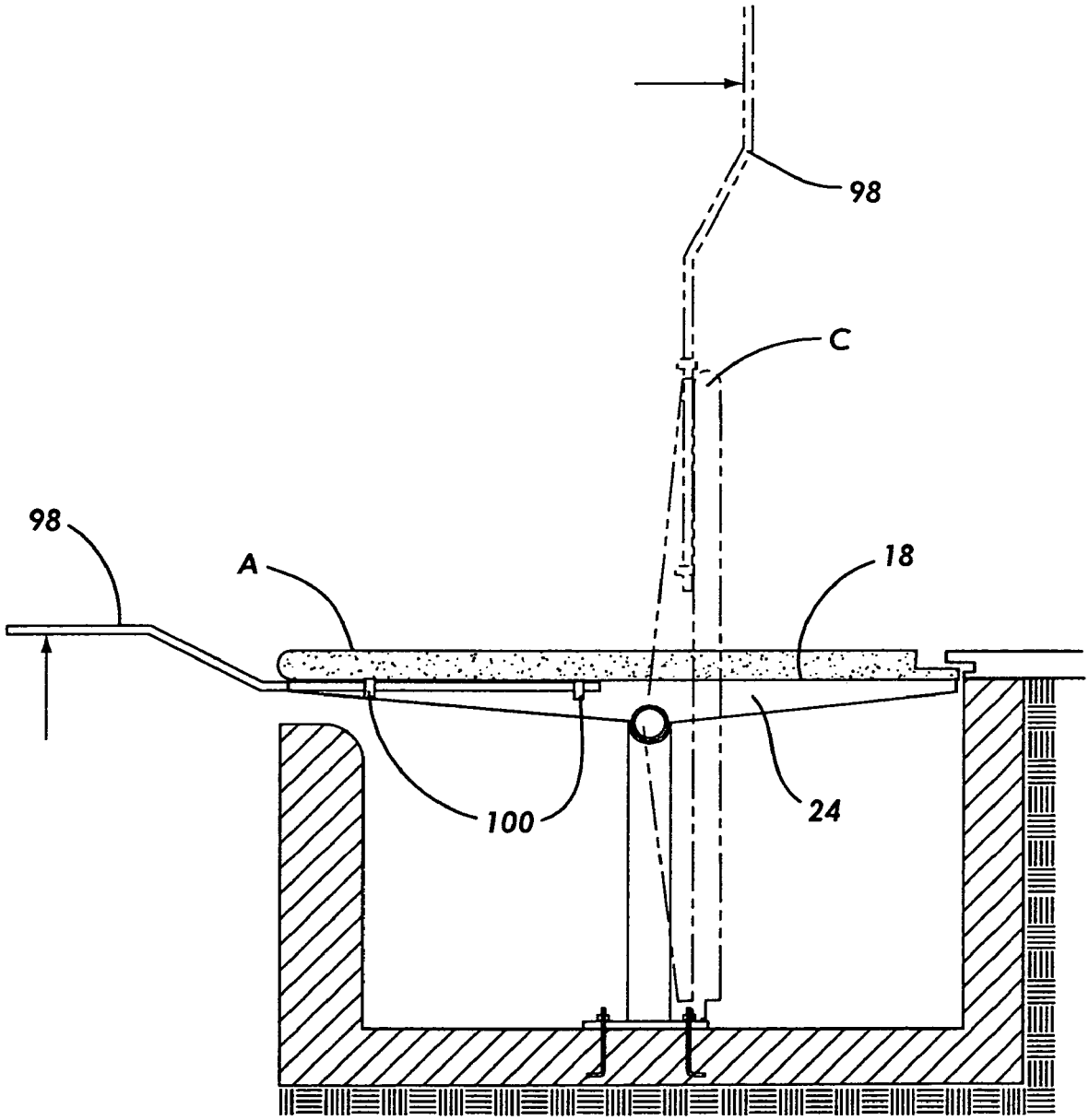
FIG. 6 is a cross-sectional side view of one method of opening the swimming pool cover with a lever.

FIG. 6 shows one possible method of moving the cover deck 18 from the closed position A to the open position C. This includes the use of a lever handle 98. In the version shown in FIG. 6, the lever handle 98 fits into guides 100 which are attached to the spar rib 24. Once the lever is secured to the spar rib 24, the cover deck 18 can be raised as shown.

Figure 7:
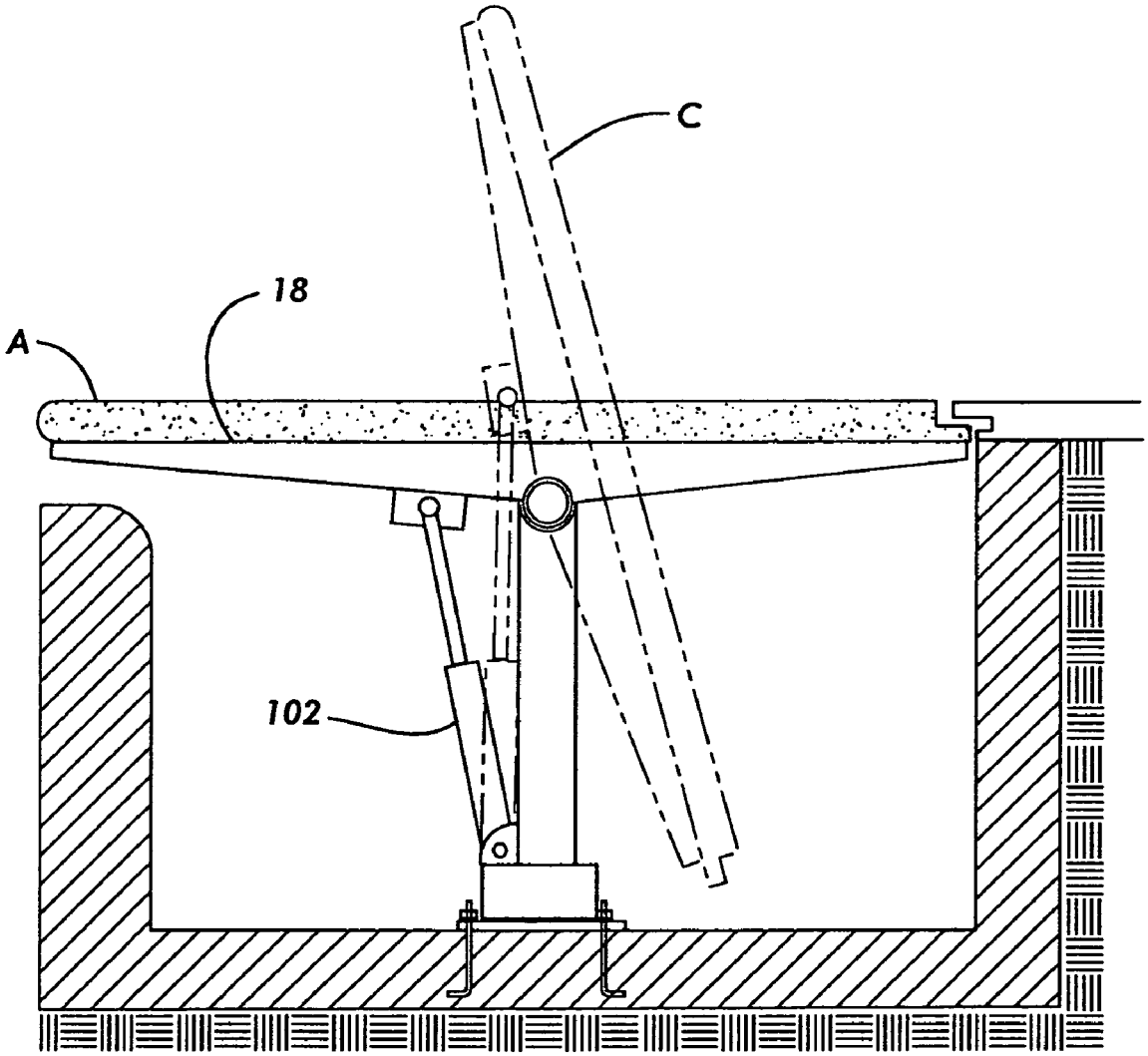
FIG. 7 is a hydraulic opening system for the cover deck.

FIG. 7 is an alternate method of raising the cover deck 18 in which a hydraulic cylinder 102 is utilized to push the cover deck 18 from the closed position A to the open position C. The cover deck 18 would be locked in the open or closed position with any of the previously discussed locking mechanisms. In the case of the hydraulic cylinder, closure would be assisted by gravity and gradual release of the piston hydraulic pressure. With the hydraulic installation, it is likely that the pistons would be located in the middle of the span and near the ends, and not adjacent to the vertical supports. However, this arrangement could be adjusted for any particular pool configuration.

Figure 8:
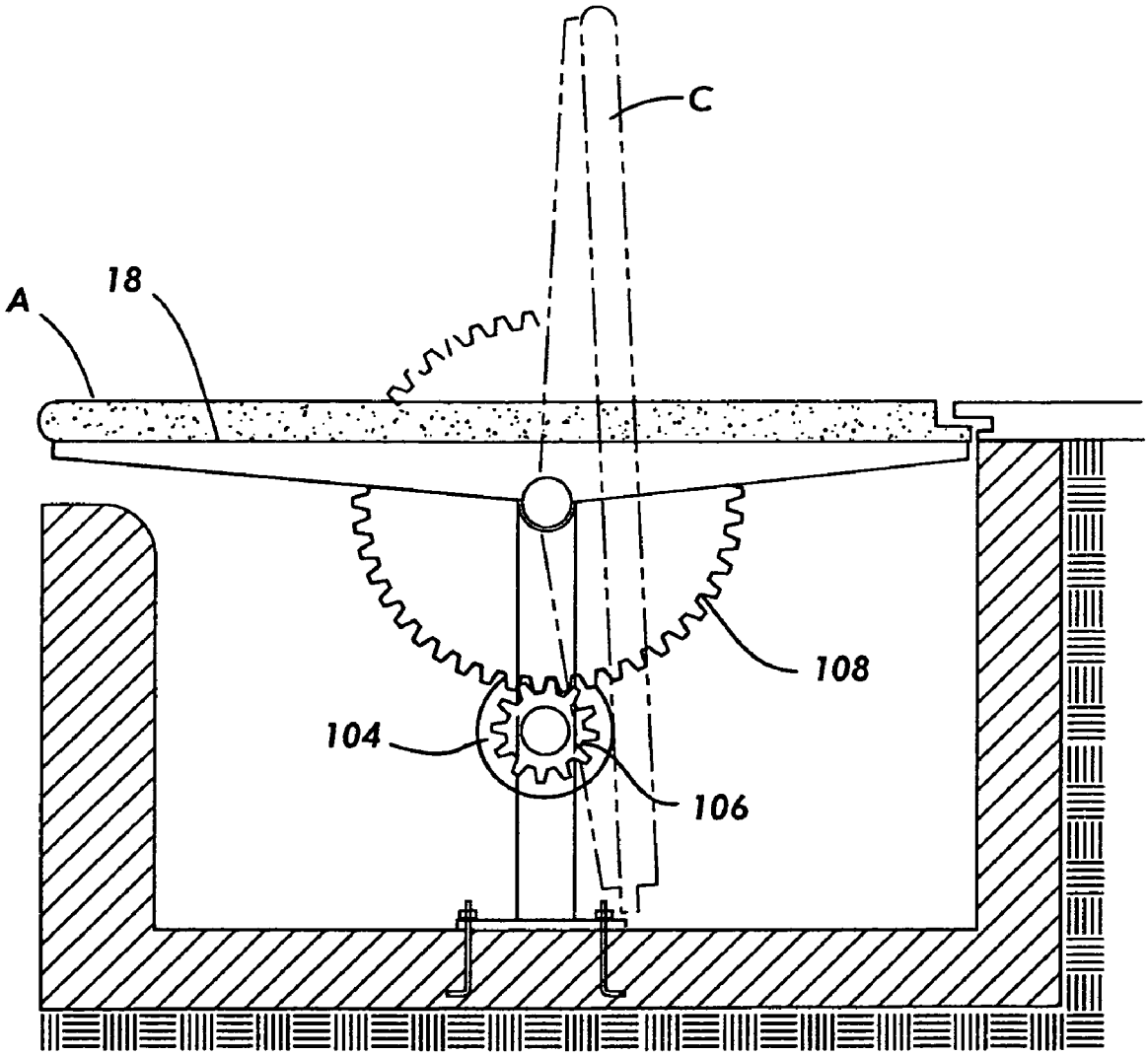
FIG. 8 is a gear driven opening system for the cover deck.

FIG. 8 shows an alternative method of opening the cover deck 18 from a closed position A to an open position C. This utilizes a motor 104, a drive gear 106 and a driven gear 108. In an opening system utilizing gears such as these, the gears could interact with a "dog" block, which could be utilized to lock the cover deck 18 at any desired angle. Although a motor 104 is shown, the drive gear 106 and the driven gear 108 could also be operated with a mechanical drive such as a crank that is rotated by hand.

Figure 9:
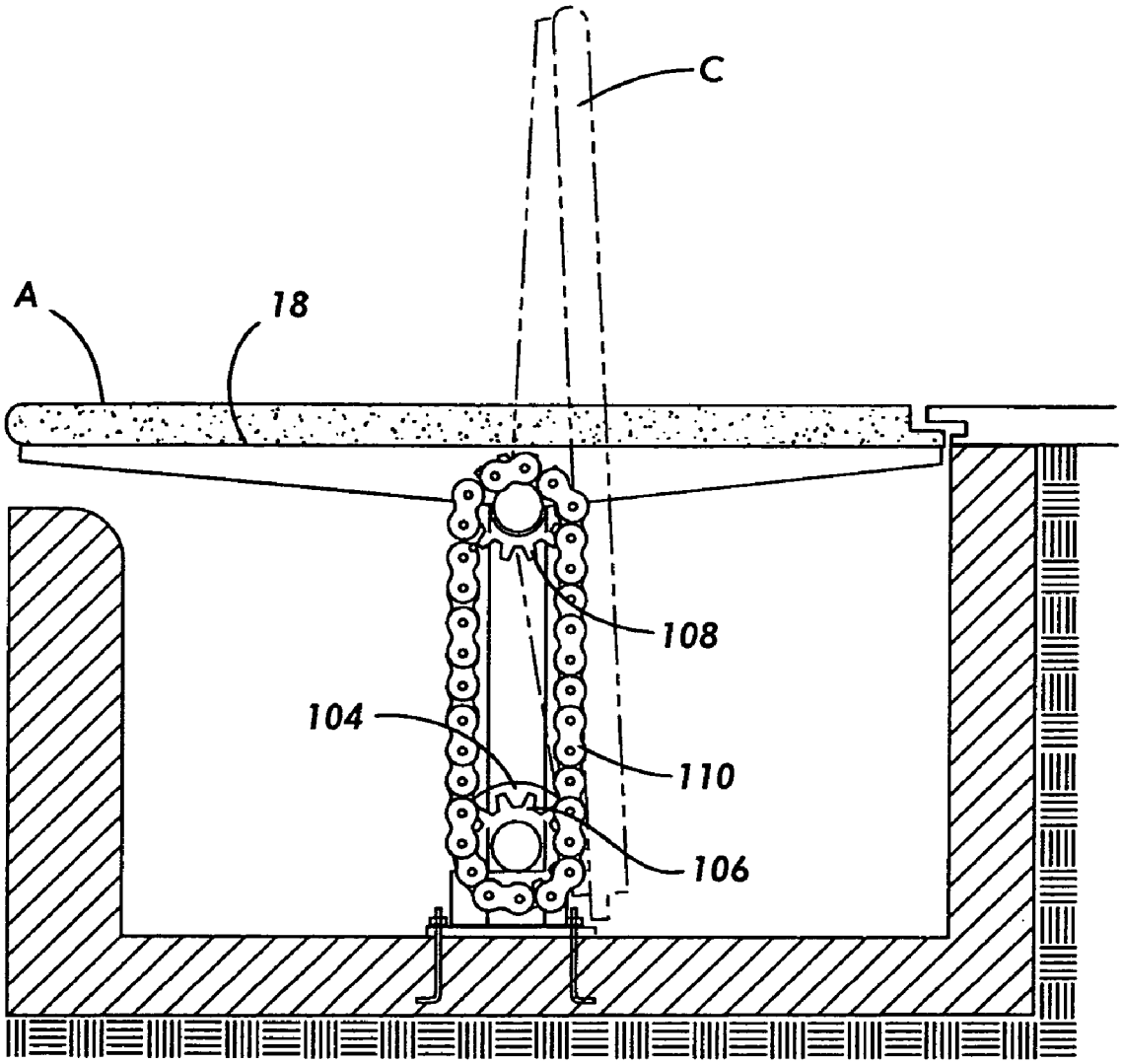
FIG. 9 is a gear and chain driven opening system for the cover deck.

FIG. 9 shows an alternative method of opening the cover deck 18. This version utilizes a chain 110, a drive gear 106 and a driven gear 108. Also shown is a motor 104. When the drive gear 106 is turned, the turning motion is transferred to the cover deck 18 by the driven gear 108. The drive gear 106 can be turned by the motor 104 as shown, or could also be driven by a manual device such as a crank, which delivers power to the drive gear 106.

Figure 10:
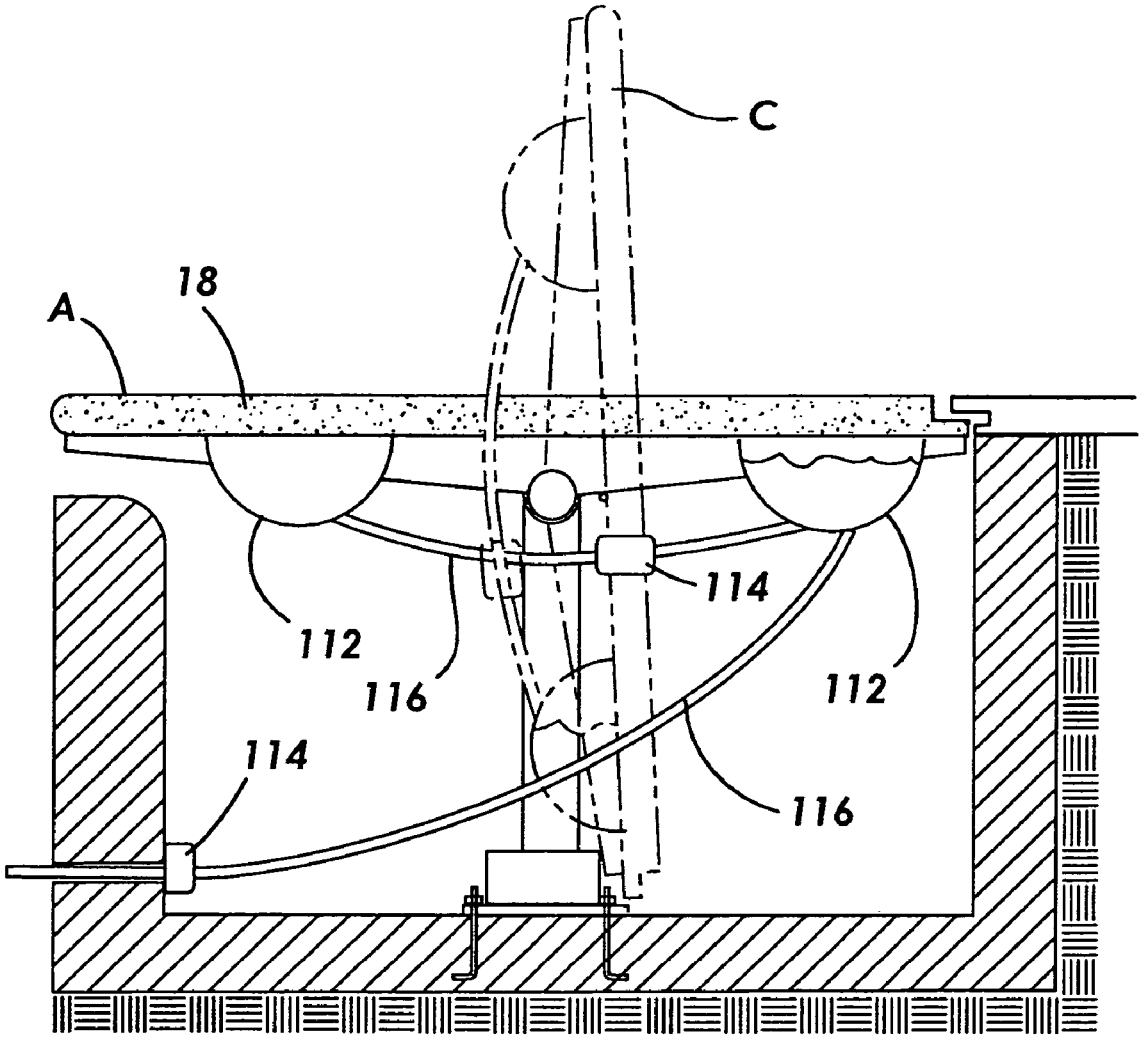
FIG. 10 is an opening system for the cover deck utilizing liquid transfers.

FIG. 10 shows an alternative method of moving the cover deck 18 from the A position to the C position. This configuration includes fluid tanks 112, fluid pumps 114 and transfer lines 116. This method operates by principal of filling the fluid holding tanks 112 to change the center of gravity of the cover deck 18. When the inner tank is filled, as shown in FIG. 10, the right hand side of the cover deck would become heavier and rotate from the A to the C position. From the C position, fluid can be pumped from the inner tank to the outer tank, thus reversing the weight and causing the cover deck 18 to rotate into the A position. Pumps 114 can be utilized to transfer fluids through the transfer lines 116 to accomplish this. This liquid for the transfer could be obtained by a connection to the swimming pool and the liquid would return to the swimming pool after use in the transfer. An alternative arrangement would be for the fluid for the tanks to be separate from the pool, and a fluid such as antifreeze could be used.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A rotatable access cover assembly adapted to selectively cover a storage chamber for storing a pool cover for a swimming pool, said storage chamber including a first and second end wall, a front sidewall having a top surface, a back sidewall and a chamber floor, said access cover assembly comprising:

a cover deck for covering said storage chamber, said cover deck comprising a pivot structure;

a plurality of pivot support structures for engaging said pivot structure of said cover deck; and said cover deck, having a first side adjacent to said storage chamber front sidewall, and a second side opposite said first side, with said cover deck configured to rotate between an open position and a closed position;

which when said cover deck is in said open position, said cover deck is oriented to allow access to said storage chamber, and when said cover deck is in said closed position, said cover deck is oriented in a generally horizontal position with said cover deck defining a slot between an underside of said cover deck and said top surface of said storage chamber front sidewall, said slot structured to allow said pool cover to pass therethrough while said cover deck is in said closed position.

2. The rotatable access cover assembly of claim 1 in which said pivot structure of said cover deck is positioned generally equidistant from said first side and said second side of said cover deck.

3. The rotatable access cover assembly of claim 1 in which said pivot structure of said cover deck is positioned generally adjacent to said first side of said cover deck.

4. The rotatable access cover assembly of claim 1 in which said pivot structure of said cover deck is positioned generally adjacent to said second side of said cover deck.

5. The rotatable access cover assembly of claim 1 in which said access cover assembly covers the entire length of said storage chamber.

6. The rotatable access cover assembly of claim 1 in which said access cover assembly covers a section of, but not the entire length of said storage chamber.

7. The rotatable access cover assembly of claim 1 in which said pivot support structures are mountable on said chamber floor.

8. The rotatable access cover assembly of claim 1 in which said pivot support structures are mountable on the first and second end walls.

9. The rotatable access cover assembly of claim 1, which further includes at least one medial pivot support structure.

10. The rotatable access cover assembly of claim 9 in which said at least one medial pivot support structure is mountable on said chamber floor.

11. The rotatable access cover assembly of claim 1 which further includes a plurality of spar ribs attached to said cover deck and connected to said pivot structure for providing support to said cover deck.

12. The rotatable access cover assembly of claim 1 in which said pivot support structures further include one or more gussets for lateral stability.

13. The rotatable access cover assembly of claim 1 in which said pivot structure is an axle which extends generally from said first end wall to said second end wall.

14. The rotatable access cover assembly of claim 1, which further includes an anti-rotation block.

15. The rotatable access cover assembly of claim 14 in which said anti-rotation block comprises an interfitting joint on said back sidewall which interacts with a back edge of said cover deck to prevent over rotation toward said front sidewall of said pool.

16. The rotatable access cover assembly of claim 14 in which said anti-rotation block comprises an interfitting joint on said first side of said cover deck which presses against a deck recess on first and second sides of an edge of said pool to prevent over rotation toward said front sidewall of said pool.

17. The rotatable access cover assembly of claim 14 in which said anti-rotation block comprises a cover blocking assembly which locks said cover deck in place to prevent over rotation toward said back sidewall.

18. The rotatable access cover assembly of claim 1, which further includes a cover deck brake means to control and stop rotation of said cover deck when moving into said open position.

19. The rotatable access cover assembly of claim 1 in which said cover deck and said pivot structure are configured so that in said open position, the center of gravity of said cover deck is between the back sidewall and at least one of the plurality of pivot support structures.

20. The rotatable access cover assembly of claim 1, which further includes a blocking mechanism for locking said cover deck in said open position.

21. The rotatable access cover assembly of claim 1 which further includes a powered device to move said cover deck.

22. The rotatable access cover assembly of claim 21 in which said powered device for moving the cover deck from the closed to the open position is a hydraulic cylinder.

23. A rotatable access cover assembly adapted to selectively cover a storage chamber for storing a pool cover of a swimming pool, said storage chamber including a left and right end wall, a front sidewall having a top surface, a back sidewall and a chamber floor, said rotatable access cover assembly comprising:

a cover deck for covering said storage chamber, comprising a plurality of spar ribs attached to said cover deck, with said spar ribs attached to an axle as a pivot structure for providing support to said cover deck;

a plurality of pivot support structures for engaging said axle of said cover deck; and said cover deck with said pivot structure, having a first side adjacent to said front sidewall, and a second side opposite said first side, with said cover deck configured to rotate between an open position and a closed position, with said axle being rotatable with said cover deck;

which when said cover deck is in said open position, said cover deck is oriented to allow access to said storage chamber, and when said cover deck is in said closed position, said cover deck is oriented in a generally horizontal position with said cover deck defining a slot between an underside of said cover deck and a top of said front sidewall.

24. A rotatable chamber cover structure configured to selectively cover a storage chamber proximate a pool having a pool wall with an upper surface, the chamber cover structure comprising:

a storage chamber lid having a top surface and a bottom surface; and a pivot coupled to the chamber lid and structured to allow the chamber lid to rotate to an open position to provide access to the storage chamber, and structured to allow the chamber lid to rotate to a closed position to form a slot opening between an upper surface of a pool wall and the bottom surface of the chamber lid.

25. The rotatable chamber cover structure of claim 24 in which the pivot comprises an axle.

26. The rotatable chamber cover structure of claim 25 in which the axle is coupled to the storage chamber lid and rotates relative to two or more axle supports that are secured to the storage chamber.

27. The rotatable chamber cover structure of claim 25 in which the axle is fixed to two or more axle supports that are secured to the storage chamber and the storage chamber lid rotates relative to the axle.

28. The rotatable chamber cover structure of claim 25 in which the axle is located on an approximate midline of the storage chamber lid.

29. The rotatable chamber cover structure of claim 25 in which the axle is located proximate an edge of the storage chamber lid.

30. The rotatable chamber cover structure of claim 25 in which the axle is located proximate an edge of the storage chamber lid most distant from the pool wall.

31. The rotatable chamber cover structure of claim 24 in which the slot opening is structured to accommodate a pool cover passed therethrough.

32. The rotatable chamber cover structure of claim 24 in which the storage chamber has a wall in common with the pool wall.

33. The rotatable chamber cover structure of claim 24, further comprising a pool deck disposed around the pool, the pool deck including a decking surface.

34. The rotatable chamber cover structure of claim 33 in which the top surface of the storage chamber lid is the decking surface.

35. The rotatable chamber cover structure of claim 34 in which, when the storage chamber lid is in the closed position, the top surface of the storage chamber lid is substantially coplanar with a top surface of the pool deck.

36. The rotatable chamber cover structure of claim 33 in which, when the storage chamber lid is in the closed position, the top surface of the storage chamber lid is substantially coplanar with a top surface of the pool deck.

37. The rotatable chamber cover structure of claim 24 in which the storage chamber lid comprises:

multiple support spars; and a sub-deck covering the multiple support spars.

38. The rotatable chamber cover structure of claim 37 in which the storage chamber lid further comprises a decking surface covering the sub-deck.

39. The rotatable chamber cover structure of claim 24, further comprising an over rotation stop.

40. The rotatable chamber cover structure of claim 39 in which the over rotation stop comprises a structural interference between the storage chamber lid and a pool deck.

41. The rotatable chamber cover structure of claim 40 in which the structural interference is a lap joint.

42. The rotatable chamber cover structure of claim 24, further comprising a brake structured to controllably prevent the storage chamber lid from rotating.

43. The rotatable chamber cover structure of claim 24 in which the storage chamber lid comprises multiple sections.

44. The rotatable chamber cover structure of claim 24 in which the storage chamber lid has the approximate dimensions of a floor of the storage chamber.

45. A partially opening deck structure, comprising:

a static portion of the deck structure located adjacent to a pool;

a hinged portion of the deck structure coupled to the static portion of the deck structure and configured to alternately cover or provide access to a storage chamber adjacent to the pool, the hinged portion having an upper surface and an underneath surface and structured to create a slot opening between the upper surface of a pool wall and the underneath surface of the hinged portion of the deck when the hinged portion of the deck is rotated closed over the storage chamber.

46. The deck structure of claim 45 in which the hinged portion of the deck includes a hinge pin axle located proximate an edge of the hinged portion.

47. The deck structure of claim 46 in which the axle is coupled to the underneath surface of the hinged portion of the deck.

48. The deck structure of claim 45 in which the slot opening is structured to accommodate a pool cover passed therethrough.

49. The deck structure of claim 45 in which the hinged portion of the deck comprises:

multiple support spars; and a sub-deck covering the multiple support spars.

50. The deck structure of claim 49 in which the upper surface of the hinged portion of the deck is a decking surface covering the sub-deck.

51. The deck structure of claim 50 in which the upper surface of the hinged portion of the deck is substantially coplanar with an upper surface of the static portion of the deck.

52. The deck structure of claim 45 in which the hinged portion of the deck comprises multiple, independently operating sections.

53. The deck structure of claim 45, further comprising an over rotation stop.

* * * * *